US005660063A

United States Patent [19]

Lee et al.

[11] Patent Number: 5,660,063

[45] Date of Patent: Aug. 26, 1997

[54] FILTER INSTALLED IN A WATER-FLOWING PATH OF A WASHING MACHINE

[75] Inventors: Seung Jun Lee; Chung Sik Jung, both of Incheon, Rep. of Korea

[73] Assignee: Daewoo Electronics Co., Ltd., Seoul, Rep. of Korea

[21] Appl. No.: 574,324

[22] Filed: Dec. 18, 1995

[30] Foreign Application Priority Data

Mar. 31, 1995 [KR] Rep. of Korea ..... 95-6463 U

[51] Int. Cl.[6] ..... D06F 39/10

[52] U.S. Cl. ..... 68/18 F; 210/167; 210/443; 210/450; 210/453

[58] Field of Search ..... 68/18 F; 134/111; 210/167, 443, 450, 453

[56] References Cited

U.S. PATENT DOCUMENTS

| | | | |
|---|---|---|---|
| 2,201,790 | 5/1940 | Rouch . | |
| 2,568,181 | 9/1951 | Zimmerman et al. | 210/453 X |
| 2,586,508 | 2/1952 | Brotman | 68/18 F X |
| 3,270,529 | 9/1966 | Engel | 68/18 F |
| 4,580,421 | 4/1986 | Babuin et al. | 68/18 F X |
| 5,066,391 | 11/1991 | Faria | 210/453 X |

FOREIGN PATENT DOCUMENTS

| | | | |
|---|---|---|---|
| 1100713 | 9/1955 | France . | |
| 1192614 | 5/1965 | Germany | 68/18 F |
| 1585818 | 10/1971 | Germany . | |
| 3731371 | 4/1989 | Germany | 68/18 F |

*Primary Examiner*—Philip R. Coe

*Attorney, Agent, or Firm*—Beveridge, DeGrandi, Weilacher & Young LLP

[57] ABSTRACT

Disclosed is a filter installed in a water-flowing path of a washing machine. The filter improves the washing effect and protects the water-flowing path in the washing machine. The filter can be easily assembled and disassembled outside the washing machine. The filter has a body being fixed to and penetrating through the housing of the washing machine, a mesh member inserted in the body to filter the washing liquid passing therethrough, a locking lid assembled integrally with and relatively rotatable to the mesh member, and an annular packing tightly wound on the mesh member to prevent leakage between the body and the mesh member. A user can insert the mesh member into the body, and then rotate the locking lid so that the first locking protuberances of the locking lid are engaged with the second locking protuberances, thereby the mesh member is assembled in the body.

28 Claims, 8 Drawing Sheets

FILTER INSTALLED IN A WATER-FLOWING PATH OF A WASHING MACHINE

BACKGROUND OF THE INVENTION

1. Field of the Invention

The present invention relates to a filter for a washing machine, and more particularly to a filter installed in a water-flowing path of a washing machine, which filters the washing liquid or the rinsing water in the washing machine, thereby improving the washing effect of the washing machine and protecting the water-flowing path, and which can be easily assembled and disassembled outside the washing machine, and thereby can be easily cleaned at any time.

2. Prior Arts

Generally, a washing machine washes, rinses, and dehydrates articles by the rotation of pulsator in a washing tub of the washing machine or the rotation of the washing tub. In the initial or middle stage of washing, rinsing, or dehydrating of the washing machine, the washing liquid or the rinsing water is introduced into or drained from the washing tub.

Recently, research and development have been focused on new washing machines in which the washing liquid or the rinsing water once having washed or rinsed the articles in the washing tub is not drained out directly but recirculated and sprayed from above the washing tub. The new washing machines aim to improve the washing and rinsing effect of the washing machine and to reduce the required washing liquid or rinsing water.

U.S. Pat. No. 5,167,722 issued to Pastryk et al. discloses a spray rinse process to effect a greater degree of soil and detergent removal. In Pastryk et al.'s spray rinse process, after the rinsing water rinsed the articles in the washing tub, it is recirculated and sprayed back onto the articles from above the washing tub.

However, in Pastryk et al.'s spray rinse process, since the rinsing water is directly recirculated and sprayed back onto the articles without being filtered after having rinsed the articles in the washing tub, impurities which may be entrained in the recirculating rinsing water may be recirculated and sprayed onto the articles along with the rinsing water. Such recirculation and spray of the impurities deteriorates the washing effect of the washing machine. Especially, in cases that the articles have a large quantity of strong impurities or dirt and that the washing liquid is recirculated in the course of washing process, the dirt or impurities in the washing liquid or the rinsing water may block off the recirculation path to thereby paralyze the function of the washing machine, or they may damage the recirculation path.

U.S. Pat. No. 5,353,612 issued to Noguchi et al. discloses a single-tub washing machine having a detachable filter. Noguchi et al.'s filter is installed at a cylindrical wall of a washing tub of the washing machine. Therefore, the filter is improper for filtering the washing liquid or rinsing water recirculating in such a recirculation path as is provided in the above described washing machine. Further, the user can not disassemble the filter outside the washing tub but only in the washing tub without bending himself into the washing tub.

SUMMARY OF THE INVENTION

The present invention has been made to overcome the above described problems of the prior arts, and accordingly it is an object of the present invention to provide a filter installed in a water-flowing path of a washing machine, which filters the washing liquid or the rinsing water in the washing machine, thereby improving the washing effect of the washing machine and protecting the water-flowing path, and which can be easily assembled and disassembled outside the washing machine, and thereby can be easily cleaned at any time.

To achieve the above object, the present invention provides a filter for a washing machine, the filter comprising:

a body installed in the washing machine, the washing machine including a housing, a washing tub for accommodating articles to be washed in the washing machine, a first water-flowing path interconnected to the washing tub, and a second water-flowing path interconnected to the first water-flowing path, the washing tub being mounted in the housing, the body being fixed to and penetrating through the housing, the body being connected to the first water-flowing path and the second water-flowing path;

a first means detachably fixed in the body from outside of the housing, the first means filtering a washing liquid or a rinsing water flowing from the first water-flowing path through the body to the second water-flowing path when the first means is inserted and fixed in the body;

a second means assembled with the first means so as to detachably fix the first means in the body;

a third means for assembling the second means with the second means; and a fourth means for preventing the washing liquid or the rinsing water from leaking between the body and the first means when the first means is fixed in the body.

Preferably, the body includes a first tube connected to the first water-flowing path, a second tube connected to the first water-flowing path, and an opening defined between the first tube and the second tube, the first tube and the second tube being interconnected through the opening to each other.

The first means includes an arcuate mesh plate longitudinally extending and being detachably inserted in the first tube, the arcuate mesh plate having a plurality of pores formed in the arcuate mesh plate, the arcuate mesh plate separating the first inner space into a first chamber and a second chamber, the first chamber and the second chamber being interconnected to each other through the pores.

The cylindrical side wall has a pair of mountain-shaped thresholds and a pair of first guide rails formed on the inner surface of the cylindrical side wall, the mountain-shaped thresholds and the first guide rails respectively extending longitudinally, and the arcuate mesh plate has a pair of plane bulwarks formed integrally with opposite sides of the arcuate mesh plate, and a pair of second guide rails respectively formed on the outer surface of each bulwark, the bulwarks and the second guide rails respectively extending longitudinally, the bulwarks sliding along the mountain-shaped thresholds and the first guide rails sliding along the second guide rails while the mesh plate is inserted into the first tube.

The second means includes a bell-mouth formed integrally with a from end of the cylindrical side wall, and a locking lid assembled with the mesh plate and being detachably locked in the bell-mouth.

The bell-mouth includes a first annular wall, a second annular wall having a diameter smaller than that of the first annular wall, a first step disposed between and formed integrally with the first annular wall and the second annular wall, and a second step formed integrally with the inner end of the second annular wall and the front end of the cylindrical side wall, so that the inner circumference of the second step has a diameter equal to the inner diameter of the cylindrical side wall, the first annular wall having a plurality of first locking protuberances formed at the inner surface of the first annular wall, the first locking protuberances protruding radially inward from the first annular wall and being spaced apart from each other with regular circumferential intervals, and the locking lid includes an annular base, a center cylinder extending downward from the inner circumference of the annular base and at a right angle to the annular base, and an outer cylinder extending upward from the outer circumference of the annular base and at a right angle to the annular base, the outer cylinder having a plurality of second locking protuberances formed on the outer surface of the outer cylinder so as to be engaged with the first locking protuberances.

The second locking protuberances are disposed on the lower end of the outer surface of the outer cylinder, each of the second locking protuberance having a trapezoidal shape, each of the second locking protuberance including a lower surface extending in the circumferential direction of the outer cylinder, an upper surface extending in the circumferential direction and more shortly than the lower surface, a side surface extending longitudinally between the lower surface and the upper surface, and an inclined surface extending with an inclination from the lower surface to the upper surface, and thereby each of the first locking protuberances slides along the inclined surface and then is tightly engaged with the upper surface of each of the second locking protuberances when the locking lid is rotated after being inserted in the bell-mouth.

The third means includes a mesh head incorporated with the front end of the arcuate mesh plate, and a pair of first arcuate engagement shelves protruding radially outward from the lower end of the center cylinder in opposite directions to each other, the mesh head including a disc-shaped base, a cylindrical bobbin extending longitudinally outward from the outer circumference of the disc-shaped base and at a right angle to the disc-shaped base, and a third annular rim protruding radially outward from the from end of the cylindrical bobbin, the cylindrical bobbin having a pair of opposite arcuate holding brackets extending longitudinally from the upper surface of the disc-shaped base, each of the arcuate holding brackets having a second arcuate engagement shelf formed at the upper end of each of the arcuate holding brackets, and thereby the third annular rim is in contact with the annular base of the locking lid, each of the first arcuate engagement shelves is slidably engaged with the second arcuate engagement shelf, so that the locking lid is assembled with the mesh head in a relatively rotatable relation.

The locking lid further includes a cylindrical knob formed integrally with the center cylinder and extending upward from the inner circumference of the annular base, and a pair of opposite ridges disposed between and formed integrally with the second annular rim and the upper surface of the cylindrical knob.

More preferably, a pair of opposite key holes are formed in the annular base of the locking lid, and a pair of key protuberances extend downward from the ridges through the key holes beyond the annular base.

A pair of opposite first stoppers and a pair of opposite second stoppers are respectively formed integrally with the disc-shaped base and the cylindrical bobbin, each of the first stoppers being disposed every between the arcuate holding brackets, each of the second stoppers being disposed near one end of each of the arcuate holding brackets, and each of the key protuberances being movable between each of the first stoppers and each of the second stoppers, and thereby a travelling range of each of the key protuberances is confined between each of the first stoppers and each of the second stoppers, and the locking lid can rotate relatively to the mesh member within a limitation.

The fourth means includes an annular packing tightly wound on the cylindrical bobbin of the mesh head, the annular packing being compressed between the second step and the third annular rim when the first locking protuberances are engaged with the second locking protuberances.

The above described filter according to the present invention filters the washing liquid passing therethrough when the washing liquid is drained or recirculated.

In the filter, the washing liquid flows as follows. The washing liquid is introduced from the discharge pipe through the neck section into the first chamber of the body. The washing liquid in the first chamber flows through the pores of the arcuate mesh plate into the second chamber, so that the arcuate mesh plate filters off impurities from the washing liquid.

The washing liquid in the second tube flows through the connection pipe into the reversible motor. The reversible motor once introduced into the reversible motor is supplied to the spray nozzle through the recirculation pipe or drained out of the washing machine through drain pipe.

According as the washing liquid is discharged through the discharge pipe and then passes through the filter repeatedly, the impurities filtered by the arcuate mesh plate is accumulated on the arcuate mesh plate. In the filter of the present invention, since the arcuate mesh plate can be easily removed from the body fixed to the washing machine outside the washing machine and then it can be cleaned, the filtering function of the arcuate mesh plate can be always maintained, and further paralysis of the function of the washing machine can be prevented.

When the mesh member is assembled in the body, a user fits the bulwark and the second guide rail of the arcuate mesh plate between the mountain-shaped threshold and the first guide rail formed on the inner surface of the cylindrical side wall, and then pushes the assembled mesh member, locking lid, and annular packing into the body.

When the arcuate mesh plate is inserted, the relative position of the cylindrical knob to the mesh head must be such that the key protuberances abut the second stoppers, and thereby the second locking protuberances of the locking lid are not hindered by the first locking protuberances of the bell-mouth but can pass by the first locking protuberances.

When the mesh member is completely inserted in the body, the user rotates the locking lid. According to the rotation of the locking lid, the first locking protuberances slide along the inclined surfaces of the second locking protuberances and then tightly engaged with the upper surfaces. At that time, the mesh member does not rotate but the first arcuate engagement shelves slide along the second arcuate engagement shelves and thereby only the locking lid rotates. While the first locking protuberances are being engaged with the upper surfaces, the mesh member and the locking lid assembled therewith proceed into the body to a distance equivalent to the longitudinal width that each first locking protuberance relatively travels along each inclined surface.

According to the tight engagement between the first locking protuberances and the second locking protuberances, the assembled mesh member, locking lid, and annular packing are tightly held in the body, and the annular packing is compressed between the second step and the third annular rim. The compressed annular packing prevents leakage of the washing liquid or the rinsing water between the body and the mesh member.

When drawing out the mesh member out of the body, the user can follow a detaching process inverse to the above described assembling process.

BRIEF DESCRIPTION OF THE DRAWINGS

The above object, and other features and advantages of the present invention will become more apparent by describing in detail preferred embodiments thereof with reference to the attached drawings, in which.

DESCRIPTION OF THE PREFERRED EMBODIMENTS

A preferred embodiment of the present invention will be described in detail with reference to the accompanying drawings.

Figure 1:
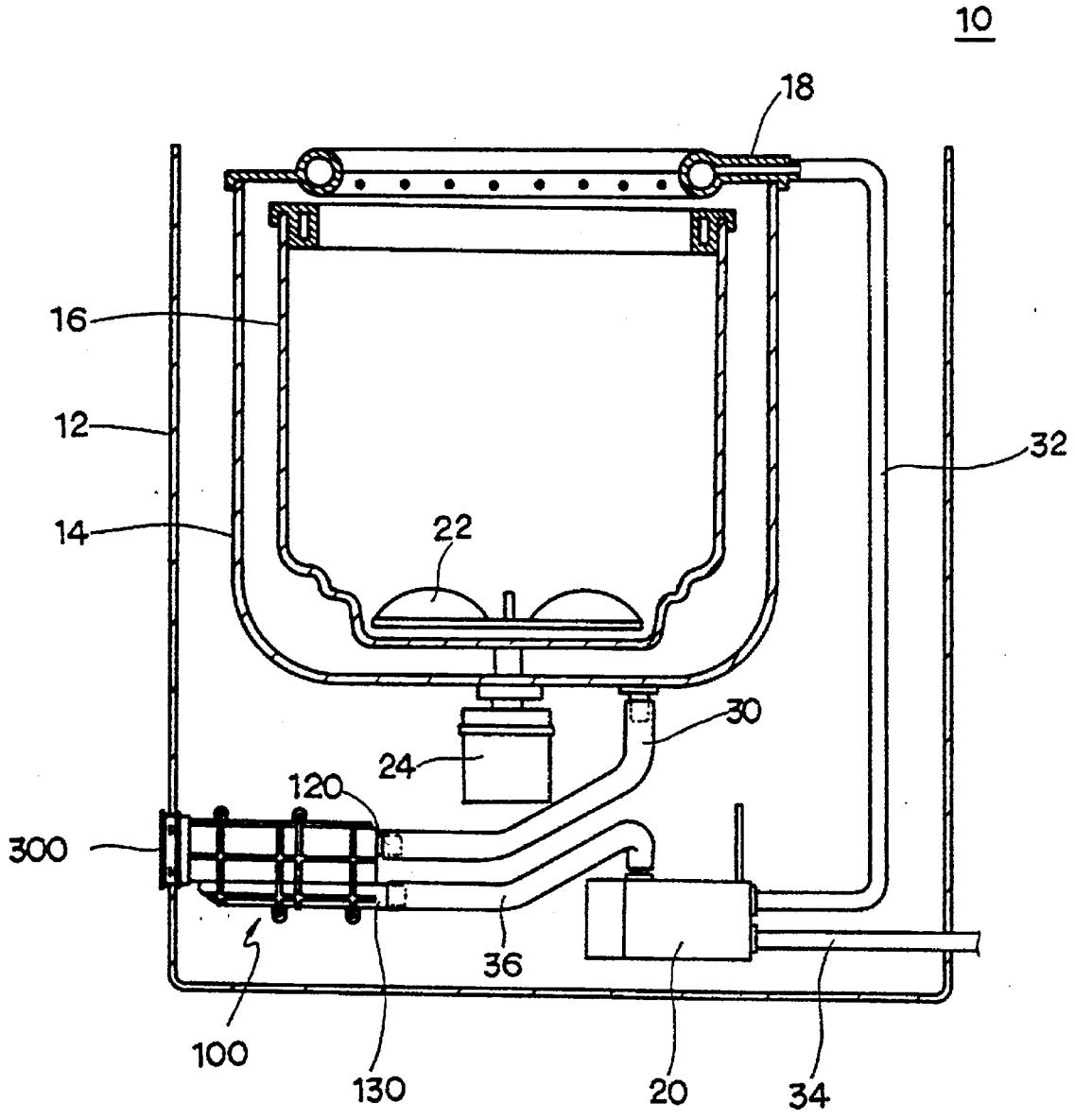
FIG. 1 is a schematic sectional view of a washing machine having a filter according to one embodiment of the present invention.

FIG. 1 illustrates a washing machine 10 having a filter 100 according to one embodiment of the present invention.

Washing machine 10 includes a housing 12, a container 14 in housing 12, and a spin tub 16 in container 14. A pulsator 22 is installed in spin tub 16. A driving motor 24 and a spray nozzle 18 are respectively disposed under and above container 14.

A filter 100 is connected through a discharge pipe 30 to container 14. Filter 100 is fixed to housing 12, and is connected through a connection pipe 36 to a reversible motor 20. A drain pipe 34 and a recirculation pipe 32 respectively extend from reversible motor 20. Drain pipe 34 extends through housing 12 out of washing machine 10, and recirculation pipe 32 is connected to spray nozzle 18.

Washing machine 10 having the above described construction washes, rinses, and dehydrates articles by the rotation of pulsator 22 or spin tub 16. In the course of the washing, rinsing, or dehydrating by washing machine 10, all or a part of the washing liquid or the rinsing water is drained out of washing machine 10 or recirculated and then sprayed through spray nozzle 18.

When the washing liquid or the rinsing water, which hereinafter will be called as the washing liquid, is drained out of washing machine 10, it flows through discharge pipe 30, filter 100, connection pipe 36, reversible motor 20, and drain pipe 34. In the meantime, the washing liquid is recirculated through discharge pipe 30, filter 100, connection pipe 36, reversible motor 20, and recirculation pipe 32, and then sprayed through spray nozzle 18. In the course of the recirculation and drainage of the washing liquid as above, filter 100 filters the washing liquid passing therethrough.

Figure 2:
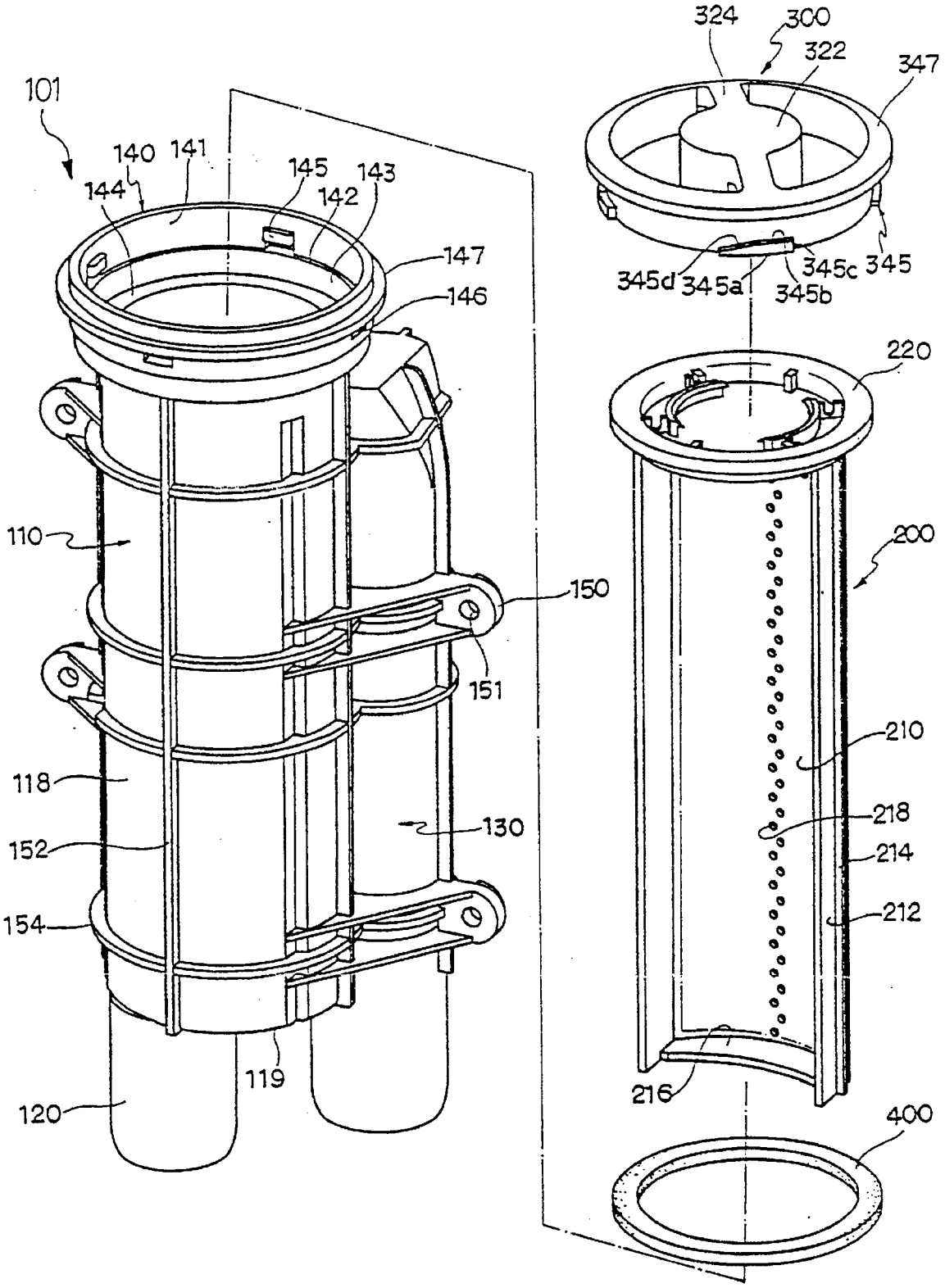
FIG. 2 is an exploded perspective view of the filter shown in FIG. 1.

FIG. 2 shows an exploded perspective view of filter 100. Filter 100 includes a body 101, a mesh member 200, a locking lid 300, and an annular packing 400. Body 101 is connected to discharge pipe 30 and connection pipe 36. Mesh member 200 can be assembled in body 101 by locking lid 300 so as to filter out impurities from the washing liquid. Annular packing 400 prevents the washing liquid from leaking between body 101 and mesh member 200.

Body 101 has the first tube 110 and the second tube 130 incorporated with first tube 110. First tube 110 has a cylindrical side wall 118, a rear wall 119 formed integrally with the rear end of cylindrical side wall 118, and a neck section 120 extending backward from rear wall 119 and formed integrally therewith. The inner space **118*a* of cylindrical side wall 118 is interconnected to inner space 120*a* of neck section 120. The diameter of neck section 120 is smaller than the diameter of cylindrical side wall 118, and neck section 120 is eccentric with cylindrical side wall 118. Preferably, the circumference of neck section 120 abuts the circumference of rear wall 119 at one point, the diameter of neck section 120 is an half of the diameter of cylindrical side wall 118**.

As shown in FIG. 1, neck section 120 of first tube 110 is connected to drain pipe 34, and second tube 130 is connected to connection pipe 36. Locking lid 300 forms a part of the outer surface of housing 12.

Referring again to FIG. 2, a bell-mouth 140 is formed integrally with the front end of cylindrical side wall 118. Bell-mouth 140 includes a first annular wall 141, a second annular wall 143 having a diameter smaller than that of first annular wall 141, a first step 142 disposed between first annular wall 141 and second annular wall 143 and formed integrally with them, a second step 144 formed integrally with the inner end of second annular wall 143 and the front end of cylindrical side wall 118. Therefore, the inner circumference of second step 144 has the same diameter with the inner diameter of cylindrical side wall 118.

A first annular rim 147 is formed on the outer surface of first annular wall 141. First annular rim 147 protrudes radially outward therefrom, and abuts housing 12 so as to support filter 100.

First annular wall 141 has four locking holes, 146 penetrating therethrough and disposed inside first annular rim 147. A rectangular first locking protuberance 145 protrudes radially inward from first annular wall 141 outside each of locking hole 146. Four locking holes 146 and four first locking protuberances 145 are spaced apart from each other with regular circumferential intervals.

A plurality of longitudinal reinforcement ribs 152 and a plurality of annular reinforcement ribs 154 are formed on the outer surfaces of first tube 110 and second tube 130. Also, a plurality of fixing brackets 150 for fixing filter 100 to housing 12 of washing machine 10 are formed on the outer surfaces of first tube 110 and neck section 120. Each fixing bracket 150 has a screw hole 151, and filter 100 is fixed to housing 12 by screws or bolts (not shown) penetrating through screw hole 151.

Mesh member 200 has an arcuate mesh plate 210 extending longitudinally. Arcuate mesh plate 210 has a plurality of pores 218 formed therein. A pair of plane bulwarks 212 are formed integrally with the opposite sides of arcuate mesh plate 210. A second guide rail 214 extending longitudinally is formed on the outer surface of each bulwark 212. A rear plate 216 having a half-moon shape is formed integrally with the rear end of arcuate mesh plate 210, and a mesh head 220 for assembling locking lid 300 with mesh member 200 is formed integrally with the front end of arcuate mesh plate 210.

Figure 3:
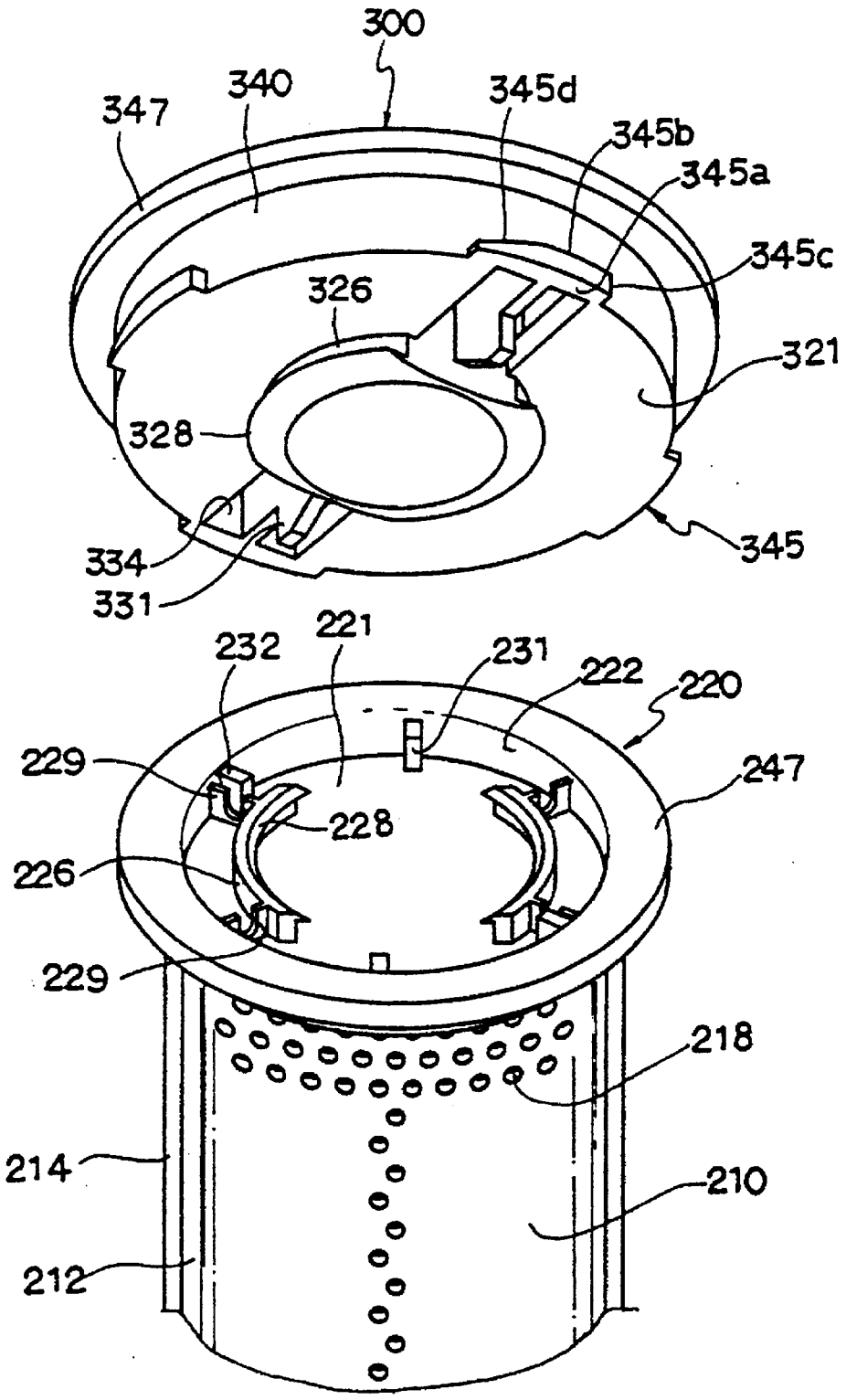
FIG. 3 is an enlarged perspective view of the mesh head and the locking lid of the filter shown in FIG. 2.

FIG. 3 is an enlarged perspective view of mesh head 220 and locking lid 300 for showing their constructions in detail.

Locking lid 300 includes an annular base 321, a center cylinder 326 extending downward from the inner circumference of annular base 321 and at a right angle to annular base 321, and outer cylinder 340 extending upward from the outer circumference of annular base 321 and at a right angle to annular base 321. Annular base 321 has a pair of opposite key holes 334 formed therein. A second annular rim 347 extends radially outward from the upper end of outer cylinder 340. Second annular rim 347 overlaps on the outer surface of housing 12, thereby improving the external appearance of housing 12, when locking lid 300 is locked in bell-mouth 140. A pair of first arcuate engagement shelves 328 protrude radially outward from the lower end of center cylinder 326 in opposite directions to each other.

Four trapezoidal second locking protuberances 345 are formed on the lower end of the outer surface of outer cylinder 340. Four second locking protuberances 345 are spaced apart from each other with regular circumferential intervals, and respectively correspond to each first locking protuberance 145. Each second locking protuberance 345 includes a lower surface 345*a* extending in a circumferential direction of outer cylinder 340, an upper surface 345*b* extending in the circumferential direction and more shortly than lower surface 345*a*, a side surface 345*c* extending longitudinally between lower surface 345*a* and upper surface 345*b*, and an inclined surface 345*d* extending with an inclination from lower surface 345*a* to upper surface 345*b*.

Referring to FIG. 2, a cylindrical knob 322 formed integrally with center cylinder 326 extends upward from the inner circumference of annular base 321. A pair of opposite ridges 324 are disposed between second annular rim 347 and the upper surface of cylindrical knob 322 and formed integrally with them.

Referring again to FIG. 3, a key protuberance 331 extends downward from each ridge 324 through each key hole 334 beyond annular base 321.

Mesh head 220 includes a disc-shaped base 221, a cylindrical bobbin 222 extending longitudinally outward from the outer circumference of disc-shaped base 221 and at a right angle to disc-shaped base 221, and a third annular rim 247 protruding radially outward from the front end of cylindrical bobbin 222. A pair of opposite arcuate holding brackets 226 extend longitudinally from the upper surface of disc-shaped base 221. Arcuate holding brackets 226 are disposed inside cylindrical bobbin 222 and have the same curvature with that of cylindrical bobbin 222. Each arcuate holding bracket 226 has a second arcuate engagement shelf 228 formed at the upper end thereof.

A pair of support brackets 229 for supporting each arcuate holding bracket 226 are disposed between cylindrical bobbin 222 and the opposite ends of each arcuate holding bracket 226. Support brackets 229 are formed integrally with arcuate holding bracket 226 and cylindrical bobbin 222. A pair of opposite first stoppers 231 and a pair of opposite second stoppers 232 are respectively formed integrally with disc-shaped base 221 and cylindrical bobbin 222 between two arcuate holding brackets 226. Each second stopper 232 is disposed near one end of each arcuate holding bracket 226.

Mesh member 200, annular packing 400, and locking lid 300 are assembled as follows. First arcuate engagement shelf 328 of locking lid 300 is slidably engaged with second arcuate engagement shelf 228 of mesh head 220, and accordingly mesh member 200 is assembled with locking lid 300 in relatively rotatable relation. In this case, each key protuberance 331 is disposed between each first stopper 231 and each second stopper 232, so that the travelling range of key protuberance 331 is confined between first stopper 231 and second stopper 232, and thereby the relative rotation of locking lid 300 to mesh member 200 is also restricted therebetween.

Annular packing 400 is tightly wound on cylindrical bobbin 222 of mesh head 220.

Figure 4:
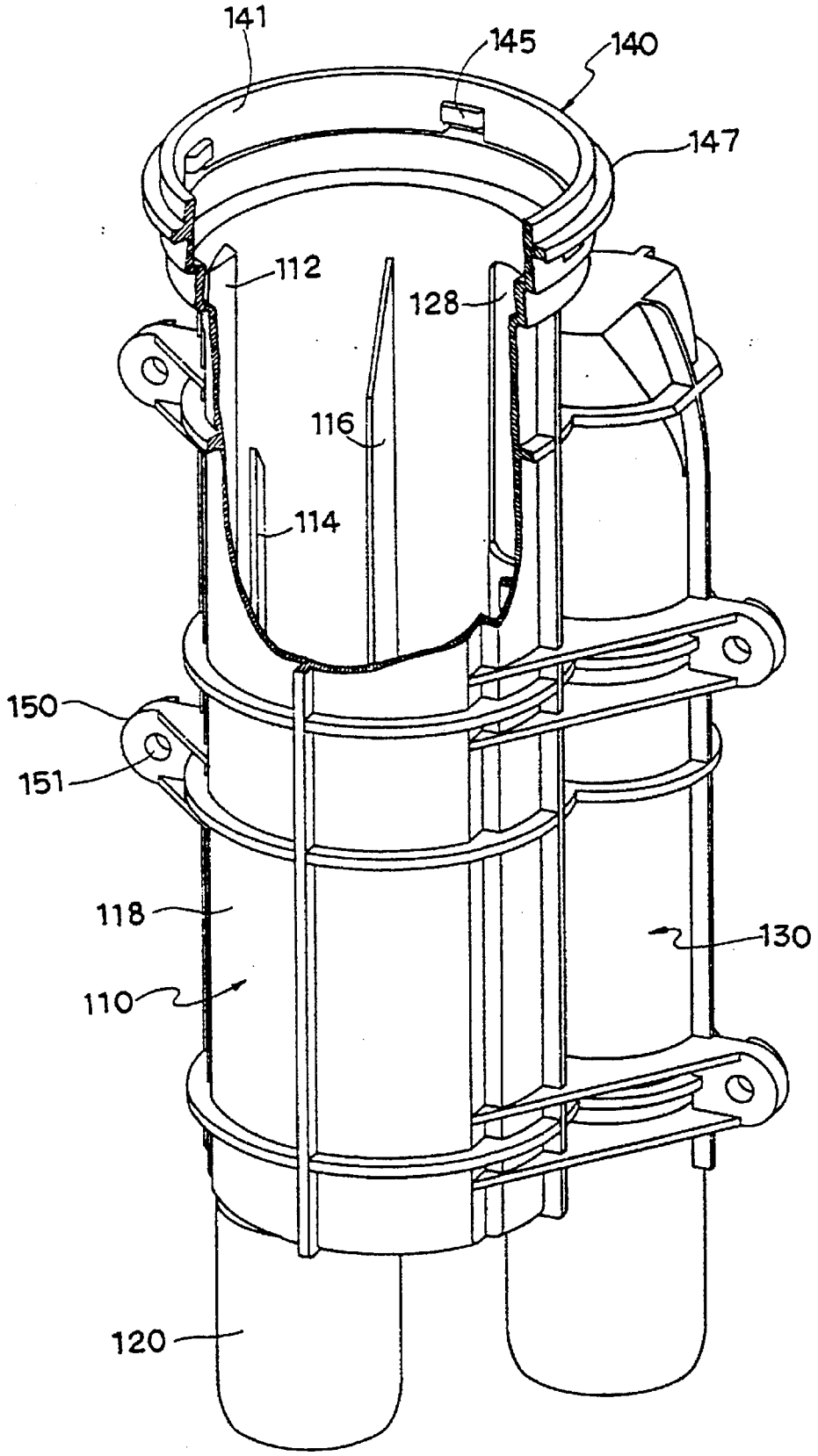
FIG. 4 is a partly cut-out perspective view of the body of the filter shown in FIG. 2.

FIG. 4 is a partly cut-out perspective view of body 101. As shown in FIG. 4, an opening 128 is formed near the front end of cylindrical side wall 118 which constitutes a boundary between first tube 110 and second tube 130. First tube 110 and second tube 130 are interconnected through opening 128 to each other. A pair of mountain-shaped thresholds 112 and a pair of first guide rails 114 are formed on the inner surface of cylindrical side wall 118. Mountain-shaped thresholds 112 and first guide rails 114 extend longitudinally, respectively.

Figure 5:
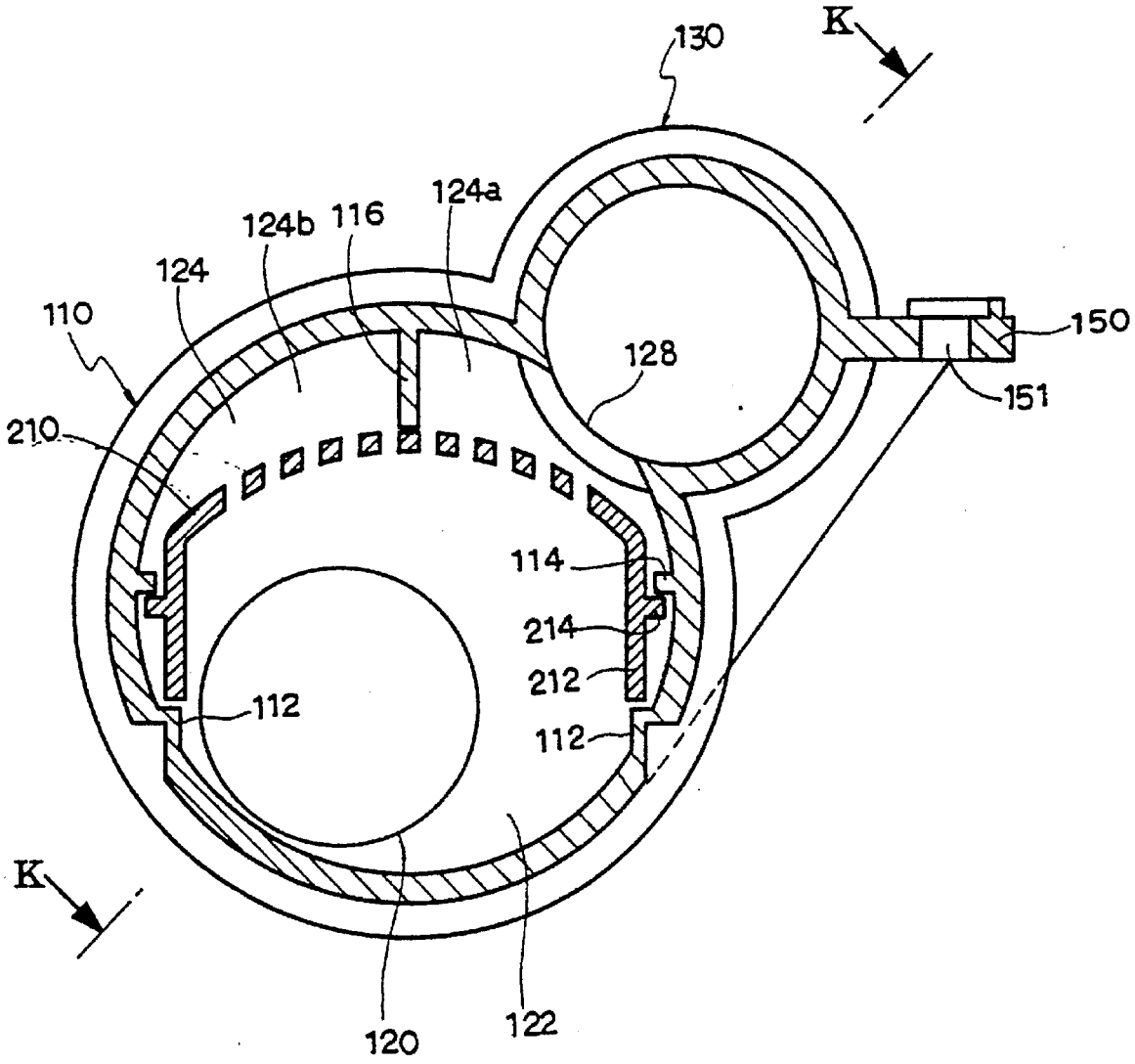
FIG. 5 is a longitudinal section of the filter shown in FIG. 2.

As shown in FIG. 5, mountain-shaped threshold 112 are located farther from second tube 130 than first guide rails 114. Preferably, the distance between 113 and first guide rail 114 has a value such that the upper end of bulwark 212 can contact with 113 and first guide rail 114 can contact with second guide rail 214 when mesh member 200 is inserted into body 101. When mesh member 200 has been inserted in body 101, arcuate mesh plate 210 separates inner space 118*a* of first tube 110 to a first chamber 122 and a second chamber 124. First chamber 122 and second chamber 124 are interconnected through pores 218 formed in arcuate mesh plate 210.

A support fence 116 is disposed on the inner surface of cylindrical side wall 118 and between first guide rails 114. Support fence 116 extends longitudinally from rear wall 119 of first tube 110 to a position in the middle of the inner surface of cylindrical side wall 118. Support fence 116 partitions second chamber 124 into a first compartment 124*a* and a second compartment 124*b*, and first compartment 124*a* and second compartment 124*b* are interconnected to each other through the space at the front of support fence 116 because support fence 116 does not extend up to the front end of cylindrical side wall 118 but to a position in the middle of the inner surface of cylindrical side wall 118 from rear wall 119 of first tube 110.

In the meantime, filter 100 filters the washing liquid passing therethrough when the washing liquid is drained or recirculated.

In filter 100, the washing liquid flows as follows. The washing liquid is introduced from discharge pipe 30 through neck section 120 into first chamber 122 of body 101. The washing liquid in first chamber 122 flows through pores 218 of arcuate mesh plate 210 into second chamber 124, so that arcuate mesh plate 210 filters off impurities from the washing liquid.

A part of the washing liquid in first chamber 122 flows into first compartment 124*a* of second chamber 124, and the other part into second compartment 124*b*. The part of the washing liquid once having flowed into first compartment 124*a* proceeds through opening 128 into second tube 130. The other part of the washing liquid once having flowed into second compartment 124*b* turns around through the front space of support fence 116 into first compartment 124*a* and then proceeds through opening 128 into second tube 130. In this case, the separation of the washing liquid into first compartment 124*a* and second compartment 124*b*, and the extension of the flowing path of the washing liquid through second compartment 124*b* intensify the vortex of the entire washing liquid in body 101, thereby strengthening the filtering force of arcuate mesh plate 210.

The washing liquid in second tube 130 flows through connection pipe 36 into reversible motor 20. Reversible motor 20 once introduced into reversible motor 20 is supplied to spray nozzle 18 through recirculation pipe 32 or drained out of washing machine 10 through drain pipe 34.

According as the washing liquid is discharged through discharge pipe 30 and then passes through filter 100 repeatedly, the impurities filtered by arcuate mesh plate 210 is accumulated on arcuate mesh plate 210. The accumulated impurities on arcuate mesh plate 210 can block off pores 218 of arcuate mesh plate 210, thereby making the recirculation and the drainage of the washing liquid impossible and paralyzing the function of 10.

In filter 100 of the present invention, since arcuate mesh plate 210 can be easily removed from body 101 fixed to washing machine 10 outside washing machine 10 and then it can be cleaned, the filtering function of arcuate mesh plate 210 can be always maintained, and further paralysis of the function of washing machine 10 can be prevented.

The above description is according to an embodiment in which filter 100 is installed in a drainage path or a recirculation path of 10. While on the other, filter 100 may be installed in a supply path, and in this case, the washing liquid can be introduced into spin tub 16 after being filtered.

Hereinafter, a process for assembling mesh member 200 in body 101 will be described in detail referring to FIGS. 5 through 8.

Body 101 is fixed to housing 12 of washing machine 10 as described above, and first annular rim 147 abuts housing 12 as shown in FIG. 1. Mesh member 200, locking lid 300, and annular packing 400 are tightly assembled with each other.

A user fits bulwark 212 and second guide rail 214 of arcuate mesh plate 210 between mountain-shaped threshold 112 and first guide rail 114 formed on the inner surface of cylindrical side wall 118, and then pushes the assembled mesh member 200, locking lid 300, and annular packing 400 into body 101. In this case, bulwark 212 and second guide rail 214 respectively contact with and slide along 113 and first guide rail 114, and thereby arcuate mesh plate 210 is prevented from rotating. FIG. 5 is a longitudinal section of filter 100 in which arcuate mesh plate 210 is completely inserted in body 101.

Figure 7:
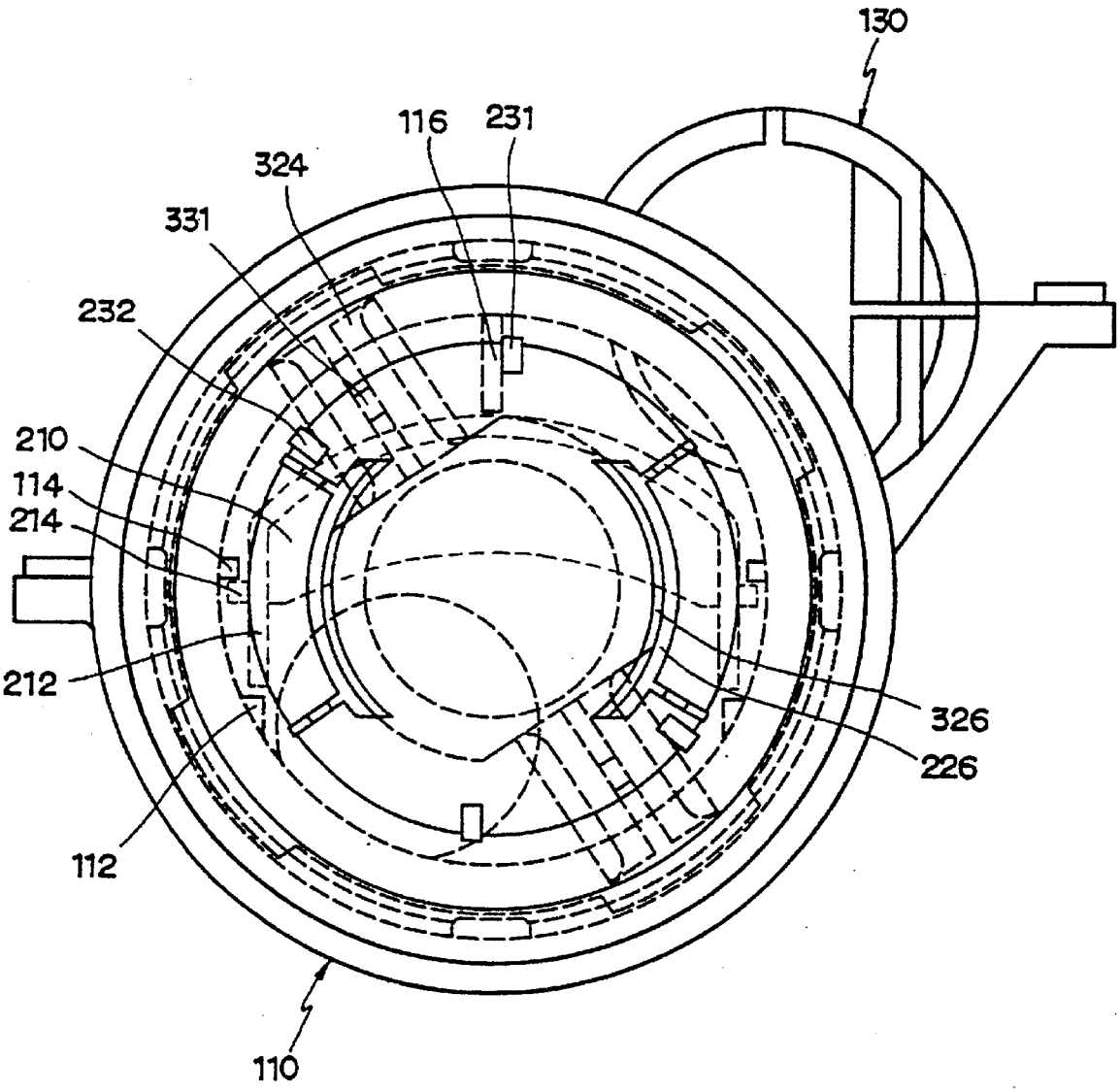
FIGS. 7 and 8 are side elevations of the filter shown in FIG. 2, in which the assembled mesh member and locking lid are simply inserted in the body, and rotated and locked in the body, respectively.

When arcuate mesh plate 210 is inserted, the relative position of cylindrical knob 322 to mesh head 220 must be such that key protuberances 331 abut second stoppers 232 as shown in FIG. 7, and thereby second locking protuberances 345 of locking lid 300 are not hindered by first locking protuberances 145 of bell-mouth 140 but can pass by first locking protuberances 145. Therefore, the assembled mesh member 200, locking lid 300, and annular packing 400 are inserted into body 101 until rear plate 216 abuts rear wall 119 of body 101.

Figure 6:
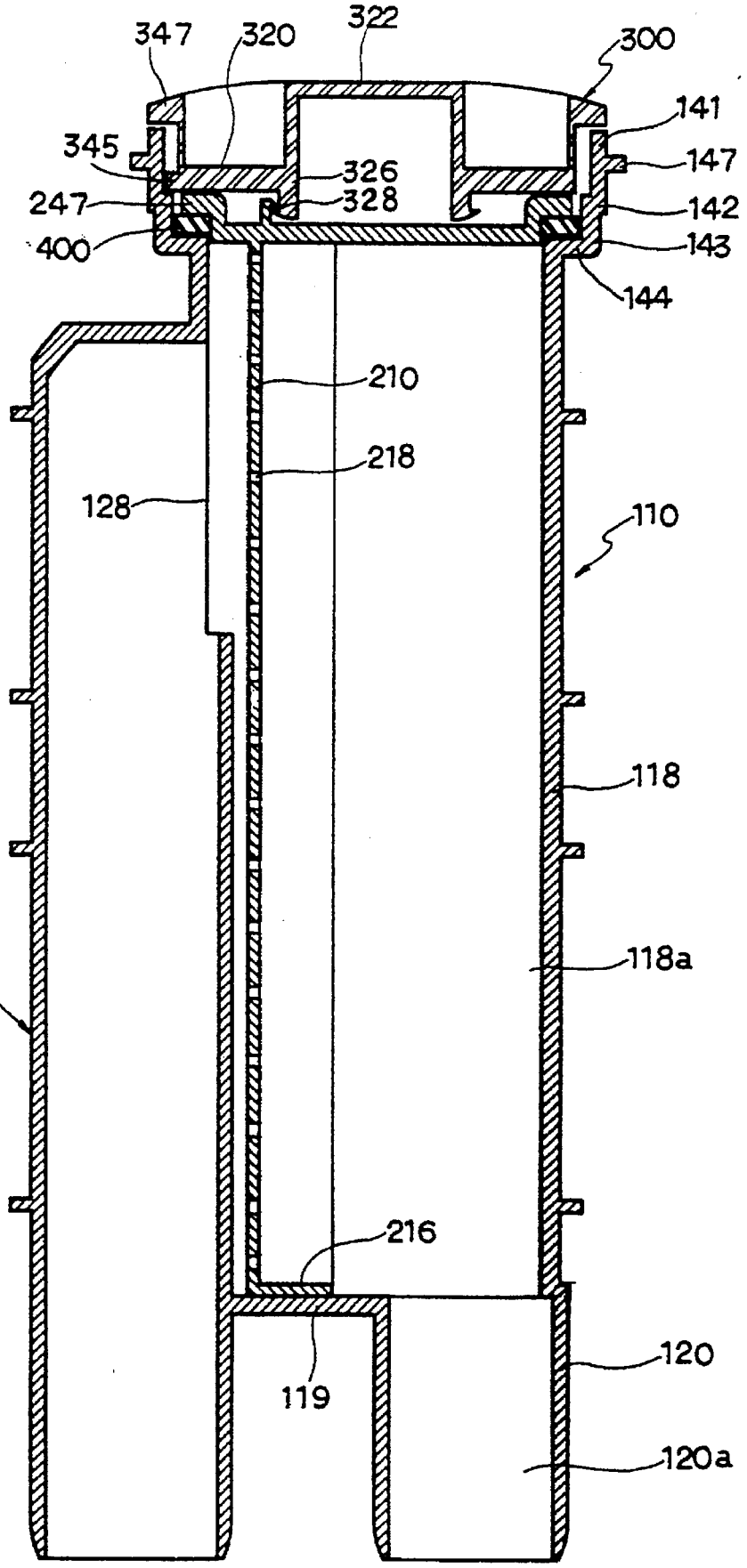
FIG. 6 is a transverse section of the filter along K—K line in FIG. 5.

When rear plate 216 abuts rear wall 119 and thereby the assembled mesh member 200, locking lid 300, and annular packing 400 are completely inserted in body 101, each first locking protuberance 145 is aligned with a point on each inclined surface 345*d* in its longitudinal position, and annular packing 400 is in contact with second step 144 of bell-mouth 140 and third annular rim 247 of mesh head 220 as shown in FIG. 6.

Then, the user rotates locking lid 300. According to the rotation of locking lid 300, first locking protuberances 145 slide along inclined surfaces 345*d* of second locking protuberances 345 and then tightly engaged with upper surfaces 345*b*. At that time, mesh member 200 does not rotate but first arcuate engagement shelves 328 slide along second arcuate engagement shelves 228 and thereby only locking lid 300 rotates. While first locking protuberances 145 are being engaged with upper surfaces 345*b*, mesh member 200 and locking lid 300 assembled therewith proceed into body 101 to a distance equivalent to the longitudinal width that each first locking protuberance 145 relatively travels along inclined surface 345*d*. Then, first locking protuberances 145 become visible through locking hole 146.

Figure 8:
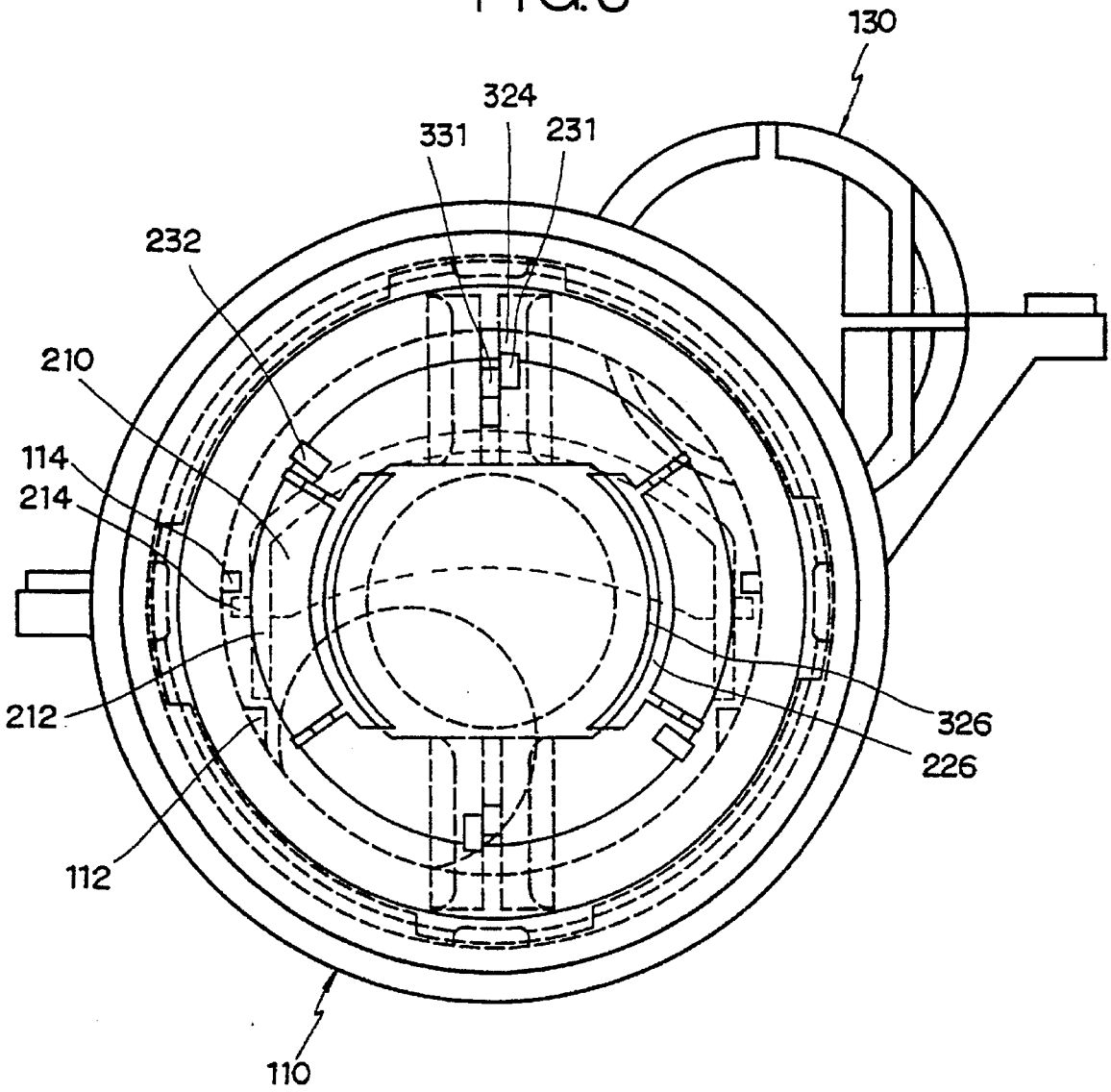

FIG. 8 shows a side view of filter 100 in which the engagement between first locking protuberances 145 and second locking protuberances 345 has been completed. According to the tight engagement between first locking protuberances 145 and second locking protuberances 345, the assembled mesh member 200, locking lid 300, and annular packing 400 are tightly held in body 101, and annular packing 400 is compressed between second step 144 and third annular rim 247. The compressed annular packing 400 prevents leakage of the washing liquid or the rinsing water between body 101 and mesh member 200.

When drawing out mesh member 200 out of body 101, the user can follow a detaching process inverse to the above described assembling process. That is, from the state that the assembled mesh member 200, annular packing 400, and locking lid 300 are tightly assembled in body 101 as shown in FIG. 8, the user grips cylindrical knob 322 and rotates locking lid 300 to the state as shown in FIG. 7, thereby releasing the engagement between first locking protuberances 145 and second locking protuberances 345.

Then, the user pulls out cylindrical knob 322, and the incorporated mesh member 200, annular packing 400, and locking lid 300 are drawn out of body 101 while bulwark 212 and second guide rail 214 are respectively guided along mountain-shaped threshold 112 and first guide rail 114.

As described above, the present invention provides filter 100 which can be installed among a recirculation path or a drainage path in washing machine 10 and can filter the recirculating washing liquid, so that purified washing liquid can be sprayed into spin tub 16 through spray nozzle 18.

Therefore, filter 100 of the present invention prevents impurities from recirculating and being sprayed onto the articles together with the washing liquid, thereby preventing the washing effect of washing machine 10 from deteriorating. Filter 100 further prevents dangers that impurities, which may be entrained in the recirculating or draining washing liquid, may block off the flowing path such as the recirculation or drainage path or may damage the flowing path, thereby paralyzing the function of 10.

Especially, filter 100 of the present invention filters the washing liquid drained at last to sewage, and accordingly it can prevent the quantity of dirts from increasing in the sewage and contribute to the reduction of water pollution and further to the conservation of nature.

In filter 100 of the present invention, arcuate mesh plate 210 can not only filter impurities according to the tight lock of the assembled mesh member 200, annular packing 400, and locking lid 300 in body 101 as described above, but also be easily separated and drawn out from body 101 outside washing machine 10 at any time. The user can maintain the filtering function of arcuate mesh plate 210 all the time and prevent the function of washing machine 10 from being paralyzed, by separating and cleaning arcuate mesh plate 210 when the washing process or the rinsing process is not performed by 10.

In addition, since filter 100 is fixed to housing 12 of washing machine 10 and locking lid 300 is exposed to the outside of washing machine 10 as shown in FIG. 1, there is provided such a convenience that arcuate mesh plate 210 can be easily assembled in and detached from body 101 of filter 100 without the separation of the entire filter 100 from 10.

Moreover, annular packing 400 compressed between body 101 fixed to housing 12 and mesh member 200 prevents leakage of the washing liquid therebetween, thereby consolidating the above convenience as a great advantage provided by the present invention.

Furthermore, filter 100 can filter the initially-introduced washing liquid before supplying it into spin tub 16 when it is installed in a water-supply path of 10.

While the present invention has been particularly shown and described with reference to the particular embodiment thereof, it will be understood by those skilled in the art that various changes in form and details may be effected therein without departing from the spirit and scope of the invention as defined by the appended claims.

What is claimed is:

1. A filter for a washing machine including a housing, a washing tub for accommodating articles to be washed in the washing machine, a first water-flowing path interconnected to the washing tub, and a second water-flowing path interconnected to the first water-flowing path, the washing tub being mounted in the housing, the filter comprising:

a body installed in the washing machine, the body being fixed to and penetrating through the housing, the body being connected to the first water-flowing path and the second water-flowing path, said body comprising a first tube connected to the first water-flowing path, a second tube connected to the second water-flowing path, and an opening defined between the first tube and the second tube, the first tube and the second tube being interconnected through the opening to each other, the first tube comprising a cylindrical side wall, a rear wall formed integrally with a rear end of the cylindrical side wall, and a neck section formed integrally with and extending backward from the rear wall, the cylindrical side wall having a first inner space interconnected to a second inner space of the neck section, the inner space being interconnected to the first water-flowing path;

a first means detachably fixed in the body from outside of the housing, the first means filtering a washing liquid or a rinsing water flowing from the first water-flowing path through the body to the second water-flowing path when the first means is inserted and fixed in the body;

a second means assembled with the first means for detachably fixing the first means in the body;

a third means for assembling the first means with the second means; and a fourth means for preventing the washing liquid or the rinsing water from leaking between the body and first means when first means is fixed in the body.

2. A filter as claimed in claim 1, wherein the neck section has a diameter smaller than that of the cylindrical side wall, the neck section being eccentric with the cylindrical side wall.

3. A filter as claimed in claim 1, wherein the neck section has a diameter which is an half of that of the cylindrical side wall, and a circumference of the neck section abuts that of the rear wall at one point.

4. A filter as claimed in claim 1, wherein the first means comprises an arcuate mesh plate longitudinally extending and being detachably inserted in the first tube, the arcuate mesh plate having a plurality of pores formed in the arcuate mesh plate, the arcuate mesh plate separating the first inner space into a first chamber and a second chamber, the first chamber and the second chamber being interconnected to each other through the pores.

5. A filter as claimed in claim 4, wherein the cylindrical side wall has a pair of mountain-shaped thresholds and a pair of first guide rails formed on an inner surface of the cylindrical side wall, the mountain-shaped thresholds and the first guide rails respectively extending longitudinally, and the arcuate mesh plate has a pair of plane bulwarks formed integrally with opposite sides of the arcuate mesh plate, and a pair of second guide rails respectively formed on an outer surface of each bulwark, the bulwarks and the second guide rails respectively extending longitudinally, the bulwarks sliding along the mountain-shaped thresholds and the first guide rails sliding along the second guide rails while the mesh plate is inserted into the first tube.

6. A filter as claimed in claim 4, wherein the cylindrical side wall has a support fence disposed on an inner surface of the cylindrical side wall and between the first guide rails, the support fence extending longitudinally from the rear wall to a middle point of the inner surface of the cylindrical side wall, the support fence partitioning the second chamber into a first compartment and a second compartment, and the first compartment and the second compartment being interconnected to each other through a space before the support fence.

7. A filter as claimed in claim 4, wherein the second means comprises a bell-mouth formed integrally with a front end of the cylindrical side wall, and a locking lid assembled with the mesh plate and being detachably locked in the bell-mouth.

8. A filter as claimed in claim 7, wherein the bell-mouth comprises a first annular wall, a second annular wall having a diameter smaller than that of the first annular wall, a first step disposed between and formed integrally with the first annular wall and the second annular wall, and a second step formed integrally with an inner end of the second annular wall and the from end of the cylindrical side wall, so that an inner circumference of the second step has a diameter equal to an inner diameter of the cylindrical side wall, the first annular wall having a plurality of first locking protuberances formed at an inner surface of the first annular wall, the first locking protuberances protruding radially inward from the first annular wall and being spaced apart from each other with regular circumferential intervals, and the locking lid comprises an annular base, a center cylinder extending downward from an inner circumference of the annular base and at a right angle to the annular base, and an outer cylinder extending upward from an outer circumference of the annular base and at a right angle to the annular base, the outer cylinder having a plurality of second locking protuberances formed on an outer surface of the outer cylinder so as to be engaged with the first locking protuberances.

9. A filter as claimed in claim 8, wherein the first annular wall has a first annular rim formed on and protruding radially outward from an outer surface of the first annular wall, the first annular rim abutting the housing so as to support the body of the filter.

10. A filter as claimed in claim 8, wherein the locking lid further comprises a second annular rim extending radially outward from an upper end of the outer cylinder, the second annular rim overlapping on an outer surface of the housing when the locking lid is locked in the bell-mouth.

11. A filter as claimed in claim 8, wherein the second locking protuberances are disposed on a lower end of the outer surface of the outer cylinder, each of the second locking protuberance having a trapezoidal shape, each of the second locking protuberance including a lower surface extending in a circumferential direction of the outer cylinder, an upper surface extending in the circumferential direction and more shortly than the lower surface, a side surface extending longitudinally between the lower surface and the upper surface, and an inclined surface extending with an inclination from the lower surface to the upper surface, whereby each of the first locking protuberances slides along the inclined surface and then is tightly engaged with the upper surface of each of the second locking protuberances when the locking lid is rotated after being inserted in the bell-mouth.

12. A filter as claimed in claim 8, wherein the first annular wall has a plurality of locking holes penetrating through the annular wall, each of the locking holes being disposed inside each of the first locking protuberances.

13. A filter as claimed in claim 8, wherein the third means comprises a mesh head incorporated with a front end of the arcuate mesh plate, and a pair of first arcuate engagement shelves protruding radially outward from a lower end of the center cylinder in opposite directions to each other, the mesh head including a disc-shaped base, a cylindrical bobbin extending longitudinally outward from an outer circumference of the disc-shaped base and at a fight angle to the disc-shaped base, and a third annular rim protruding radially outward from a front end of the cylindrical bobbin, the cylindrical bobbin having a pair of opposite arcuate holding brackets extending longitudinally from an upper surface of the disc-shaped base, each of the arcuate holding brackets having a second arcuate engagement shelf formed at an upper end of each of the arcuate holding brackets, whereby the third annular rim is in contact with the annular base of the locking lid, each of the first arcuate engagement shelves is slidably engaged with the second arcuate engagement shelf, so that the locking lid is assembled with the mesh head in a relatively rotatable relation.

14. A filter as claimed in claim 13, wherein the holding brackets have curvatures equal to that of the cylindrical bobbin.

15. A filter as claimed in claim 13, wherein a pair of support brackets for supporting each of the arcuate holding brackets are disposed between the cylindrical bobbin and opposite ends of each of the arcuate holding bracket, the support brackets being formed integrally with the arcuate holding bracket and the cylindrical bobbin.

16. A filter as claimed in claim 13, wherein the locking lid further comprises a cylindrical knob formed integrally with the center cylinder and extending upward from the inner circumference of the annular base, and a pair of opposite ridges disposed between and formed integrally with the second annular rim and an upper surface of the cylindrical knob.

17. A filter as claimed in claim 16, wherein a pair of opposite key holes are formed in the annular base of the locking lid, and a pair of key protuberances extend downward from the ridges through the key holes beyond the annular base.

18. A filter as claimed in claim 17, wherein a pair of opposite first stoppers and a pair of opposite second stoppers are respectively formed integrally with the disc-shaped base and the cylindrical bobbin, each of the first stoppers being disposed every between the arcuate holding brackets, each of the second stoppers being disposed near one end of each of the arcuate holding brackets, and each of the key protuberances being movable between each of the first stoppers and each of the second stoppers, whereby a travelling range of each of the key protuberances is confined between each of the first stoppers and each of the second stoppers, and the locking lid can rotate relatively to the mesh member within a limitation.

19. A filter as claimed in claim 13, wherein the fourth means comprises an annular packing tightly wound on the cylindrical bobbin of the mesh head, the annular packing being compressed between the second step and the third annular rim when the first locking protuberances are engaged with the second locking protuberances.

20. A filter as claimed in claim 7, wherein the mesh plate comprises a rear plate having a half-moon shape and being formed integrally with a rear end of the arcuate mesh plate.

21. A filter as claimed in claim 1, wherein the first tube and the second tube have a plurality of longitudinal reinforcement ribs and a plurality of annular reinforcement ribs formed on outer surfaces of the first tube and the second tube.

22. A filter as claimed in claim 1, wherein the first tube and the second tube have a plurality of fixing brackets for fixing the filter to the housing of the washing machine, the fixing brackets being formed on outer surfaces of the first tube and the second tube.

23. A filter as claimed in claim 22, wherein each of the fixing brackets has a screw hole formed in the fixing bracket, and the filter being fixed to the housing by a fixing means screwed on the housing through the screw hole.

24. A filter as claimed in claim 1, wherein the opening is formed at a front portion of the cylindrical side wall which constitutes a boundary between the first tube and the second tube.

25. A filter as claimed in claim 1, wherein the washing machine further comprises a spray nozzle installed above the washing tub, the second water-flowing path being interconnected to the spray nozzle.

26. A filter as claimed in claim 1, wherein the second water-flowing path is a drain pipe extending out of the housing.

27. A filter as claimed in claim 1, wherein the washing machine further comprises a spray nozzle and a reversible motor respectively installed above and under the washing tub, the second water-flowing path being interconnected to the reversible motor, and the reversible motor being interconnected to the spray nozzle through a recirculation pipe to the spray nozzle and to a drain pipe extending out of the housing.

28. A filter for a washing machine including a housing, and washing tub for accommodating articles to be washed in the washing machine, a spray nozzle and a reversible motor respectively installed above and under the washing tub, a first water-flowing path interconnected to the washing tub, a second water flowing path interconnected to the first water-flowing path, a recirculation tube, and a drain pipe extending out of the housing, the washing tub being mounted in the housing, the filter comprising;

a body installed in the washing machine, the body being fixed to and penetrating through the housing, and including a first tube and a second tube, the first tube having a cylindrical side wall, a rear wall formed integrally with a rear end of the cylindrical side wall, a neck section formed integrally with and extending backward from the rear wall, and a bell-mouth formed integrally with a front end of the cylindrical side wall, the cylindrical side wall having a pair of mountain-shaped thresholds and a pair of first guide rails formed on an inner surface of the cylindrical side wall, the mountain-shaped thresholds and the first guide rails respectively extending longitudinally, the cylindrical side wall having a first inner space interconnected to a second inner space of the neck section, the first and the second inner spaces being respectively interconnected the first and the second water flowing paths, the cylindrical side wall having an opening defined between the first tube and the second tube, the first inner space and the second inner space being interconnected through the opening to each other, the neck section having a diameter smaller than that of the cylindrical side wall, the neck section being eccentric with the cylindrical side wall, the neck section having a circumference abutting that of the rear wall at one point, the bell-mouth including a first annular wall, a second annular wall having a diameter smaller than that of the first annular wall, a first step disposed between and formed integrally with the first annular wall and the second annular wall, and a second step formed integrally with an inner end of the second annular wall and the front end of the cylindrical side wall, so that an inner circumference of the second step has a diameter equal to an inner diameter of the cylindrical side wall, the first annular wall having a plurality of first locking protuberances formed at an inner surface of the first annular wall, the first locking protuberances protruding radially inward from the first annular wall and being spaced apart from each other with regular circumferential intervals, the first annular wall having a first annular rim formed on and protruding radially outward from an outer surface of the first annular wall, the first annular rim abutting the housing so as to support the body of the filter, the first annular wall having a plurality of locking holes penetrating through the annular wall, each of the locking holes being disposed inside each of the first locking protuberances, the second water-flowing path being interconnected to the reversible motor, and the reversible motor being interconnected to the spray nozzle through the recirculation pipe to the spray nozzle and to the drain pipe;

a mesh member including an arcuate mesh plate extending longitudinally and being detachably inserted in the first tube, and a mesh head incorporated with a front end of the arcuate mesh plate, the arcuate mesh plate having a plurality of pores formed in the arcuate mesh plate, the arcuate mesh plate separating the first inner space into a first chamber and a second chamber, the first chamber and the second chamber being interconnected to each other through the pores, the arcuate mesh having a pair of plane bulwarks formed integrally with opposite sides of the arcuate mesh plate, a pair of second guide rails respectively formed on an outer surface of each bulwark, and a rear plate having a half-moon shape and being formed integrally with a rear end of the arcuate mesh place, the bulwarks and the second guide rails respectively extending longitudinally, the bulwarks sliding along the mountain-shaped thresholds and the first guide rails sliding along the second guide rails while the mesh plate is inserted into the first tube, the rear plate being in contact with the rear wall of the first tube when the locking lid is assembled in the bell-mouth, the mesh head including a disc-shaped base, a cylindrical bobbin extending longitudinally outward from an outer circumference of the disc-shaped base and at a right angle to the disc-shaped base, and a second annular rim protruding radially outward from a front end of the cylindrical bobbin, the cylindrical bobbin having a pair of opposite arcuate holding brackets extending longitudinally from an upper surface of the disc-shaped base, each of the arcuate holding brackets having a first arcuate engagement shelf formed at an upper end of each of the arcuate holding brackets, the holding brackets having curvatures equal to that of the cylindrical bobbin, a pair of support brackets for supporting each of the arcuate holding brackets being disposed between the cylindrical bobbin and opposite ends of each of the arcuate holding bracket, the support brackets being formed integrally with the arcuate holding bracket and the cylindrical bobbin, a pair of opposite first stoppers and a pair of opposite second stoppers being respectively formed integrally with the disc-shaped base and the cylindrical bobbin, each of the first stoppers being disposed every between the arcuate holding brackets, each of the second stoppers being disposed near one end of each of the arcuate holding brackets;

a looking lid including an annular base, a center cylinder extending downward from an inner circumference of the annular base and at a right angle to the annular base, an outer cylinder extending upward from an outer circumference of the annular base and at a right angle to the annular base, a third annular rim extending radially outward from an upper end of the outer cylinder, a cylindrical knob formed integrally with the center cylinder and extending upward from the inner circumference of the annular base, and a pair of opposite ridges disposed between and formed integrally with the second annular rim and an upper surface of the cylindrical knob, the outer cylinder having a plurality of second locking protuberances formed on an outer surface of the outer cylinder so as to be engaged with the first locking the third annular rim overlapping on an outer surface of the housing when the locking lid is locked in the bell-mouth, the second locking protuberances being disposes on a lower end of the outer surface of the outer cylinder, each of the second locking protuberance having a trapezoidal shape, each of the second locking protuberance including a lower surface extending in a circumferential direction of the outer cylinder, an upper surface extending in the circumferential direction and more shortly than the lower surface, a side surface extending longitudinally between the lower surface and the upper surface, and an inclined surface extending with an inclination from the lower surface to the upper surface, each of the first locking protuberances sliding along the inclined surface and then being tightly engaged with the upper surface of each of the second locking protuberances when the locking lid is rotated after being inserted in the bell-mouth, the center cylinder having a pair of second arcuate engagement shelves protruding radially outward from a lower end of the center cylinder in opposite directions to each other, the second annular rim being in contact with the annular base of the locking lid, each of the second arcuate engagement shelves being slidably engaged with the second arcuate engagement shelf, so that the locking lid is assembled with the mesh head in a relatively rotatable relation, the annular base having a pair of opposite key holes formed in the annular base, and a pair of key protuberances extending downward from the ridges through the key holes beyond the annular base, each of the key protuberances being movable between each of the first stoppers and each of the second stoppers, whereby a travelling range of each of the key protuberance is confined between each of the first stoppers and each of the second stoppers, and the locking lid can rotate relatively to the mesh member within a limitation; and an annular packing tightly wound on the cylindrical bobbin of the mesh head, the annular packing being compressed between the second step and the second annular rim when the first locking protuberances are engaged with the second locking protuberances.

* * * * *